United States Patent [19]

Sagefors

[11] Patent Number: 4,572,707

[45] Date of Patent: Feb. 25, 1986

[54] METHOD IN THE EXCAVATION OF UNDERGROUND CAVERNS IN ROCK

[75] Inventor: Ivar K. Sagefors, Stockholm, Sweden

[73] Assignee: Boliden Aktiebolag, Stockholm, Sweden

[21] Appl. No.: 638,465

[22] PCT Filed: Jan. 9, 1984

[86] PCT No.: PCT/SE84/00001

§ 371 Date: Jul. 24, 1984

§ 102(e) Date: Jul. 24, 1984

[87] PCT Pub. No.: WO84/02741

PCT Pub. Date: Jul. 19, 1984

[30] Foreign Application Priority Data

Jan. 4, 1983 [SE] Sweden ..... 8300185

[51] Int. Cl.[4] ..... B65G 5/00; E21D 13/02

[52] U.S. Cl. ..... 405/55; 405/53

[58] Field of Search ..... 405/53–59, 405/132, 133

[56] References Cited

U.S. PATENT DOCUMENTS

| | | | |
|---|---|---|---|
| 2,896,417 | 7/1959 | Meade | 405/53 X |
| 2,928,248 | 3/1960 | Hubbell | 405/53 |
| 3,068,654 | 12/1962 | Warren | 405/55 |
| 4,045,963 | 9/1977 | Hansson et al. | 405/53 |
| 4,233,789 | 11/1980 | Dinardo | 405/53 X |
| 4,363,563 | 12/1982 | Hallenius et al. | 405/53 X |
| 4,474,506 | 10/1984 | Sagefors | 405/55 |

FOREIGN PATENT DOCUMENTS

| | | | |
|---|---|---|---|
| 117212 | 9/1946 | Sweden | 405/53 |
| 176115 | 8/1961 | Sweden | 405/55 |
| 7901278-7 | 2/1979 | Sweden . | |

*Primary Examiner*—Dennis L. Taylor

*Attorney, Agent, or Firm*—Brumbaugh, Graves, Donohue & Raymond

[57] ABSTRACT

The present invention relates to a method in the excavation of rock caverns, substantially cylindrical vertical caverns, for storing liquids or dry products, or for use in storing process units, in which method an upper and a lower circumferentially extending cavern (4, 11) is formed, the caverns (4, 11) having an outer diameter which is greater than the diameter of the ultimate rock cavern (1); in which the caverns (4, 11) are connected together by means of vertical holes (12) drilled in the region immediately outside the ultimate rock cavern (1), these vertical holes (12) serving to drain water from the aforementioned region, for the purpose of minimizing the extent to which water can penetrate the rock cavern (1). (FIG. 1).

5 Claims, 3 Drawing Figures

METHOD IN THE EXCAVATION OF UNDERGROUND CAVERNS IN ROCK

DESCRIPTION

1. Technical Field

The present invention relates to a method in the excavation of caverns in rock, and in particular to the excavation of substantially vertical cylindrical caverns, in which fluids, such as oil products, dry goods, or articles of equipment can be suitably stored.

The object of the present invention is to provide a method by means of which the area adjacent a rock cavern can be drained in a simple and rational manner, thereby to minimise the risk of water leaking into said cavern.

A further objct of the invention is to provide a method by means of which a conical roof space can be blasted in said rock cavern in a simple and rational fashion, such as to enable the rock cavern to be lined thereafter with a waterproof coating.

2. Background Art

Present day rock caverns intended for the storage of oil products have the form of long, horizontal hemispherical cavities, in which the base of the cavity measures 500×25 m or more, and the height measures 30 m. Oil stored in such cavities will unavoidably rest on a bed of water, and it has been found that microorganisms thrive and multiply in the intersurface between the oil and water and destroy the oil/oil products to such an extent as to render the same completely useless. When storing refined products in this manner, it has been found necessary to re-refine said products, in order to guarantee their usefulness.

The use of substantially cylindrical, vertical rock caverns has been proposed as a solution to this problem. A description of this proposal is found, inter alia, in SE-B-7901278-7, and in subsequent articles by K. I. Sagefors et al, WP-System, Stockholm, Sweden. In accordance with the aforesaid proposal, when excavating the rock cavern a conical roof cupola is formed from a top heading in the cavity, by first drilling holes outwardly and downwardly along the cylindrical surface of the intended cupola; placing an explosive charge in each of the drill holes and exploding the charges; cutting out one or more transport tunnels which open into the wall of the ultimate vertical, cylindrical cavern; and excavating the rock from said transport tunnels, by drilling vertical blasting holes and blasting the surrounding rock, the rock debris falling to the bottom of the cavern and being removed therefrom. The bottom of the cavern has a downwardly tapering conical form, and merges with an exit tunnel, through which pipes can be drawn and the stored products removed.

In SE-B-7901278-7 it is proposed that a series of holes is arranged in a curtain-like fashion around the whole of the storage plant, or around selected areas thereof, and that the holes are filled with water, to prevent a lowering of the ground-water level, and to prevent the stored product from spreading to the surroundings through cracks, fissures and the like; in other words it is ensured that the storage plant is shielded by water-pressure.

As beforementioned, previous methods for excavating substantially cylindrical rock caverns have entailed drifting a top heading from which subsequent drilling is effected. These methods call for a large number of blasting holes to be drilled, which results in the placing of a heavy and excessive explosive charge, and therewith places the roof structure of the cavern under an unnecessarily high strain. Drifting of the top heading also disturbs and unsettles the rock located above the cavern, with the subsequent risk of impairing the stability and strength of the overlying rock formations.

The discovery that microorganisms thrive and multiply in the interface between the stored product and the water present has led to a demand for the minimum possible amount of water to be present in said cavern. In response to this demand, it has been proposed that the walls of the rock cavern be covered with a waterproof material, said wall coverings consisting of a multi-layer coating which comprises respective layers of gunite, or shotcrete, reinforced gunite, or shotcrete, epoxy resin, glass-fibre fabric, and finally a further layer of epoxy resin. The application of one such wall covering is described by Beckers-Sigma, different COLTURIET products.

It is not possible, however, for such a covering to provide durable protection, should the rock-side of the covering be subjected constantly to the pressure of water. Consequently, there have been demands for further measures to be carried out, with the intention of eliminating the presence of ambient water, in order to guarantee the resistance and durability of the waterproof covering.

DISCLOSURE OF THE INVENTION

It has now surprisingly been found possible to solve the aforementioned problem by means of the present invention, which is characterised by forming from one transport tunnel an upper circumferential chamber having a largest diameter which is greater than the diameter of the substantially cylindrical part of the intended rock cavern, at a level which lies adjacent the foot of an intended conical roof structure; by drilling from said circumferential chamber blasting holes for blasting said roof structure; by forming a bottom circumferential chamber having a largest diameter which is greater than the diameter of the substantially cylindrical part of the intended rock cavern; by drilling substantially vertical holes between said chambers in the region located immediately externally of the intended substantially cylindrical rock cavern, for the purpose of draining water from said region; and by forming the substantially cylindrical rock cavern between said upper and lower chambers in a manner known per se.

Further characterising features of the invention are set forth in the following claims.

The invention will now be described in more detail with reference to the accompanying drawings, in which FIG. 1 is a vertical sectional view of a rock cavern;

Figure 1:
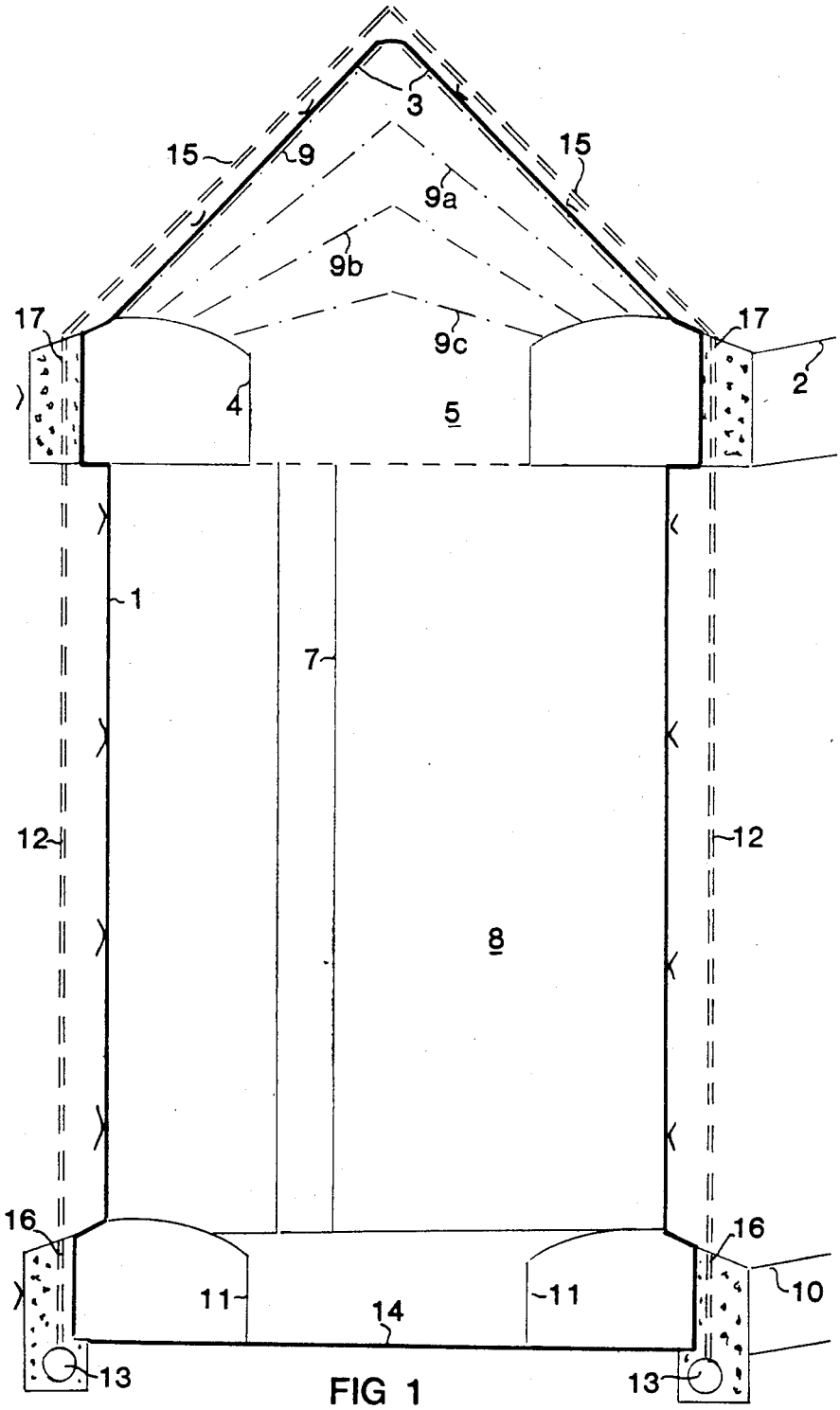

In FIG. 1 the reference 1 identifies the cylindrical surface of a substantially cylindrical vertical rock cavern. When seen in horizontal cross-section, the rock cavern has a circular or oval configuration, preferably circular. The final external contour of the rock cavern is shown in heavy black lines, while the weaker lines and broken lines illustrate the shape of the cavern while under construction. A transport tunnel or drift 2 discharges into the base of an ultimate roof structure 3, said tunnel suitably being located so that a part thereof communicates with the cylindrical outer surface of the rock cavern and a further part thereof communicates with the surface of the roof structure. From the transport tunnel 2 there is formed an annular tunnel 4 having an outer diameter which is greater than the diameter of the ultimate rock cavern (30–40 m). In the remaining core 5 located radially inwardly of the annular tunnel 4 there is formed a tunnel 6 which extends to a vertical shaft 7, which is to be used as a primary cavity when blasting the aforesaid rock cavern, excavation of said rock cavern being effected by blasting away one or more solid benches in the monolithic mass 8. Blasting holes 9 are drilled from the annular tunnel 4, upwardly and along the intended surface 3 of the ultimate roof structure, said roof structure being in the form of a cone having a base angle of 45°–60°, and thus an apex angle of 60°–90°. When placing the holes 9 for blasting the roof of the cavern, it is not necessary to extend all holes to the top, but only a sufficient number to ensure that said roof structure obtains the desired configuration. The remaining holes 9 are terminated before reaching the top. This eliminates the possibility of overcharging. At the same time as the roof blasting holes are drilled, i.e. holes 9A, 9B, 9C etc., holes are also drilled vertically, in circular rows, downwardly into the rock which is to be excavated in the rock formation. These holes have a depth of 40–60 m, depending upon the desired volume of the rock cavern.

Figure 3:
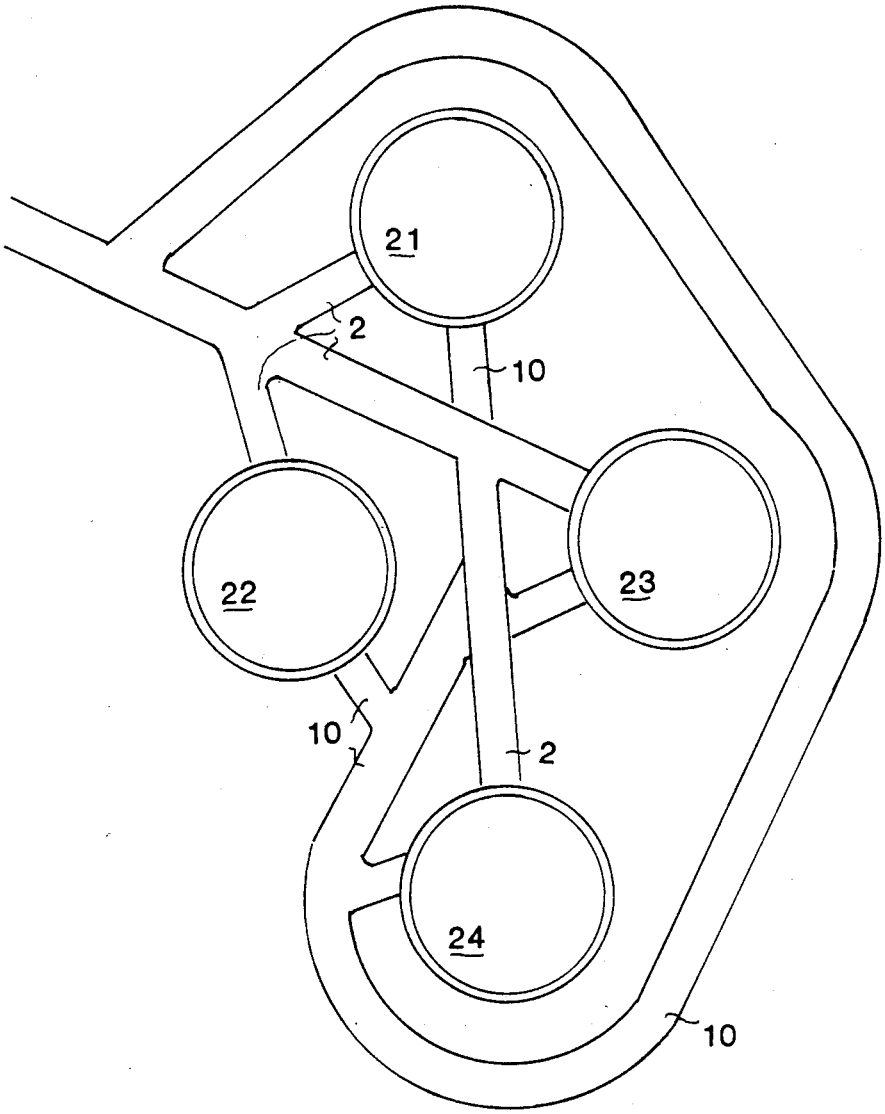
FIG. 3 illustrates a storage complex comprising a plurality of rock caverns.

The transport tunnel 2 comprises part of a transport-tunnel network, such as that illustrated in FIG. 3, part of said network leading to the bottom level of the ultimate rock cavern. In this embodiment, an access tunnel 10 extends to the bottom level of the rock cavern, and there is blasted a circumferential chamber 11 of circular or ring-like configuration having a diameter which is greater than the diameter of the rock cavern, suitably the same diameter as that of the upper, annular tunnel 4. Holes 12 are drilled from the upper tunnel 4 to the lower chamber 11 at a distance of 1–2.5 m from one another and from the wall 1 of the ultimate rock cavern, said holes 12 being connected via hoses 17, with a drainage pipe 13 which extends around the whole of the rock cavern, in a ditch arranged at a level beneath the bottom surface 14 of said cavern. The bottom drainage system slopes down to a location from which water can be pumped, optionally via a main collecting location serving a storage complex comprising a multiple of interlinked rock caverns. The purpose of the holes 12 is to carry away water which has entered the rock cavern 1. Arranged above the roof structure 3 is an umbrella of drill-holes 15, which interconnect the vertical holes 12 by means of conduits or ducts 16 cast in concrete. The ducts or conduits 17 and the drainage pipe 13 are also cast in concrete. In order to guarantee effective drainage, drainage pipes (not shown) can be buried in the bottom of the rock cavern, so that water can be conducted away in any desired manner, should any part of the circumferential pipe 13 become blocked. The bottom surface of the rock cavern suitably falls to a location at which water, sludge and/or stored fluid can be readily pumped away.

When taking out the roof of the rock cavern, the core located radially inwardly of the annular tunnel 4 is first blasted out, whereafter the roof structure is taken down in stages. When the roof structure has been formed and the rock debris removed through the transport tunnel 2, the solid monolithic rock mass 8 is blasted out and the rock debris removed through the lower transport tunnel 10.

The thus constructed roof structure is suitably lined with a waterproof covering, in the manner described above. This is suitably effected prior to excavating the major part of the cavern, since the necessary working equipment can then be rested and erected upon the upper surface of the monolithic mass 8. The major part of the rock cavern, i.e. the cylindrical part of said cavern, can be lined subsequent to blasting the solid mass 8.

In the illustrated embodiment, the bottom part of the rock cavern has an overhanging wall. It will be understood that a concrete wall can be provided immediately beneath the main wall of the rock cavern, thereby to obtain a straight, cylindrical space beneath said main wall. In this way, it is possible to provide a rearward opening for inspection purposes and for providing access to the lower part of the drainage system.

Figure 2:
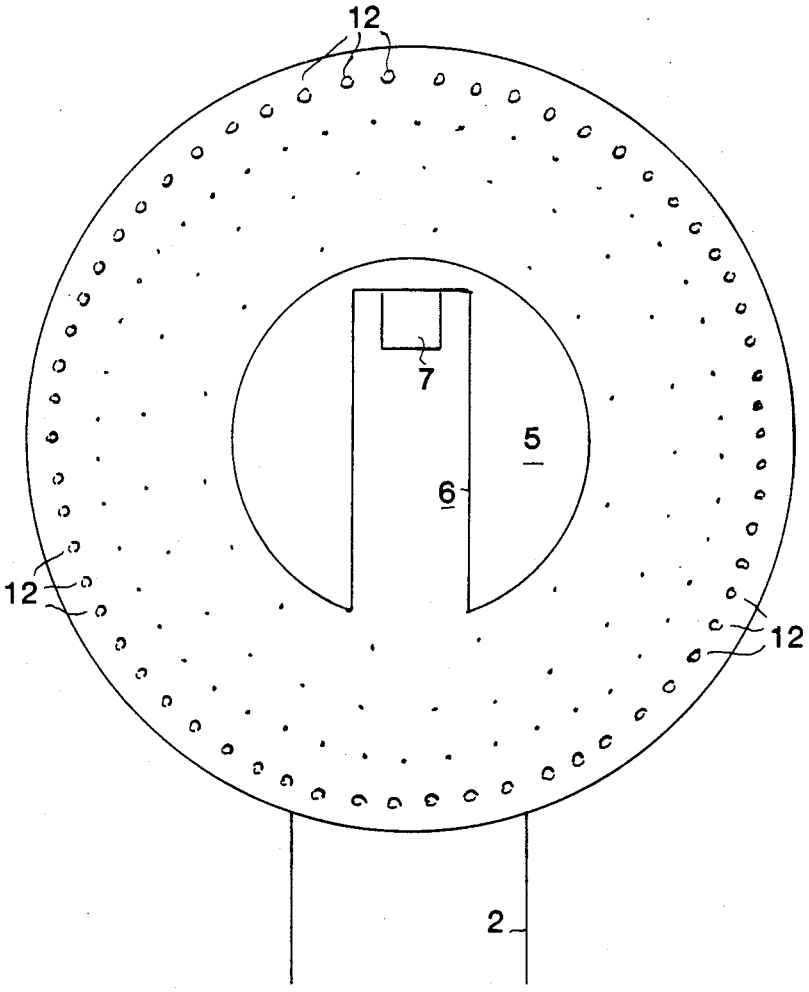
FIG. 2 is a horizontal sectional view of a rock cavern.

FIG. 2 illustrates the core in the annular tunnel 4, and the holes arranged for drilling the solid rock mass 8, and also the drainage holes 12.

FIG. 3 illustrates a storage complex comprising four rock caverns interconnected by means of access and exit tunnels 2 and 10.

By means of the present invention there is obtained a rock-cavern drainage system which prevents water from penetrating the storage caverns.

It is also possible to increase the drainage capacity in areas between the holes 12, by exploding slender rod-like charges having a diameter of 11 mm in the larger holes 12, having a diameter of 75–100 mm, thereby to form minor cracks between the holes 12.

Thus, the storage complex illustrated in FIG. 3 comprises a plurality of interlinked rock caverns, each being of substantially cylindrical shape, having a circular or oval cross-section. Each cavern forms a storage space, the rock walls of which directly absorb the pressure of the fluid stored in said cavern. As beforementioned the centre geometric axes of the caverns extend vertically, whereupon the vertical height of a respective cavern is greater than or equal to the geometric extension of its cross-section, the distance between mutually adjacent caverns being at most twice the geometric cross-sectional dimensions of respective caverns, and the centre points of the cross-sections of respective caverns, when seen in horizontal section throughout the entire complex, being located in a two-dimensional pattern.

The caverns are suitably arranged so that, when seen in horizontal cross-sectional planes, the vertical axes of said caverns are located such that connection lines in said planes between said axes in substantially each group of three mutually adjacent caverns form a triangle, all the total angles of which are between 30° and 120° C.

The storage complex is compact and requires the minimum of ground area. Thus, extremely large storage sites can be constructed within limited areas. The size of the storage area is minimal. Consequently, those arrangements and devices required to avoid a lowering of the ground-water level in the surroundings can be more readily constructed. The geometric design of the storage complex enables water curtains to be more readily provided. These water curtains comprise rows of vertical drill holes filled with water. It is possible with the aid of such water curtains to maintain the ground water-level constant within the storage complex and externally thereof, in a particularly simple fashion. Because of the relatively small area required by the storage complex, said complex can be more easily placed within a homogenous part of the rock formation in which the caverns are to be formed, thereby more readily avoiding disturbances in the surrounding rock formations.

Since each cavern has a height which is greater than its diameter, the bedrock in which the storage cavern is to be formed can be better used at depth, which enables a more compact complex to be obtained, together with improved economy with regard to the use of rock area. In addition, if the stored product is heated, an improved heat economy is also obtained.

The height of the respective caverns provides sufficient static head to enable the stored product to be readily emptied from the cavern with the aid of pumps arranged therebeneath. The extent to which pipes etc. need to be installed is far less, due to the compact design of the storage complex.

If the stored product is to be heated, heat can be supplied to a selected part of respective caverns and at a selected level therein.

If sludge is deposited from the stored products, the said sludge can be readily collected and pumped from the storage complex, rendering the provision of large spaces for the deposition of sludge in the bottom of the storage complex unnecessary.

The design of the caverns also enables transducers or control equipment, such as temperature gauges and level sensors, to be more readily arranged.

The storage complex illustrated in FIG. 3 comprises four caverns referenced 21 to 24. Each cavern has a substantially cylindrical shape. All the caverns are located in bedrock at a given depth beneath the surface of the ground.

The caverns are mutually lined together, both at the upper parts and lower parts thereof. The tunnels connecting the upper parts of respective caverns are referenced 2, while the tunnels connecting the lower parts of said caverns are referenced 10.

Overhead cranes (not shown), enabling inspection of the cavern lining, can be placed on the uppermost shelf located in the cylindrical part of said cavity and formed by the tunnel 4.

When the cavern is used as a machine hall, the transport of material can be effected by overhead cranes.

The rock can be sealed by injecting a suitable sealing material through drill holes. Thus, in the illustrated embodiment a row of holes can be drilled between the walls of the rock cavern and the drainage holes 12, and a sealing material injected into said holes, said material penetrating the microcracks present in the rock. Suitable sealing materials include silicone elastomers, etc.

Since the storage cavern is dry, it can also be used to store effectively nuclear waste of low and average activity, obtained from nuclear power stations and nuclear research stations, in addition to the aforementioned storage products.

I claim:

1. A method in the excavations of caverns in rock, and in particular in the excavation of substantially vertical cylindrical caverns, in which fluids and other oil products, dry products and processing equipment can be stored, characterised by forming from a transport tunnel (2) an upper circumferentially extending chamber (4) having an outer diameter which is greater than the diameter of the substantially cylindrical part of the ultimate rock cavern (1), at a level located adjacent the base of the roof structure of said ultimate rock cavern; forming a lower circumferentially extending chamber (11) having an outer diameter which is greater than the diameter of the substantially cylindrical part of said ultimate rock cavern (1); drilling vertical holes (12) between said chambers (4, 11), in a region immediately outside the ultimate substantially cylindrical rock cavern (1), for draining water from said region; and forming the substantially cylindrical rock cavern between said upper and said lower chambers (4, 11) in a manner known per se.

2. A method according to claim 1, characterised by drilling holes (9) outwardly from said upper chamber (4), for the purpose of excavating a conical roof structure (3).

3. A method according to claim 1, characterised by providing drill holes (15) above the conical roof structure (3), so that said drill holes (15) connect with the vertical drill holes (12).

4. A method according to claim 1, characterised in that the vertical drill holes (12) are connected to a drainage means (13) which extends around the bottom surface (14) of the rock cavern (1).

5. A method according to any one of claim 1, 3 and 4, characterised by forming microcracks between the drill holes (12, 15), by detonating slender rod charges.

* * * * *